US005651440A

United States Patent [19]

Hien et al.

[11] Patent Number: 5,651,440

[45] Date of Patent: Jul. 29, 1997

[54] DISENGAGEABLE UNIVERSAL SHAFT FOR ROLLING MILL DRIVES

[75] Inventors: Manfred Hien, Mönchengladbach; Paul Koenen, Krefeld, both of Germany

[73] Assignee: Mannesmann Aktiengesellschaft, Dusseldorf, Germany

[21] Appl. No.: 310,413

[22] Filed: Sep. 22, 1994

[30] Foreign Application Priority Data

Sep. 22, 1993 [DE] Germany ..... 43 32 893.8

[51] Int. Cl.[6] ..... B21B 35/14; F16D 11/14

[52] U.S. Cl. ..... 192/69.9; 192/85 CA; 192/96

[58] Field of Search ..... 192/96, 85 A, 192/69.9, 85 CA; 241/231, 232, 37; 464/157, 136; 403/57

[56] References Cited

U.S. PATENT DOCUMENTS 2,620,054 12/1952 Munschauer ..... 192/85 A
2,893,222 7/1959 Albedyhl et al. ..... 464/157 X
3,252,527 5/1966 Alexander et al. ..... 464/157 X
4,595,087 6/1986 Morisawa et al. ..... 192/85 A X

FOREIGN PATENT DOCUMENTS 1902665 8/1970 Germany .

*Primary Examiner*—Rodney H. Bonck
*Attorney, Agent, or Firm*—Cohen, Pontani, Lieberman, Pavane

[57] ABSTRACT

A disengageable universal shaft for rolling mill drives having a flange on the roll side that can be coupled centrally with the coupling sleeve attached to the roll shaft and a flange at the gear side that is connected with the drive via a spline shaft that enables the disengaging movement. The spline shaft is penetrated centrally by an extensible part of a piston-cylinder unit and is constructed at the output stub on the gear side. This output stub is enclosed by a longitudinally displaceable coupling bushing that is connected with the flange of the universal shaft on the gear side.

5 Claims, 1 Drawing Sheet

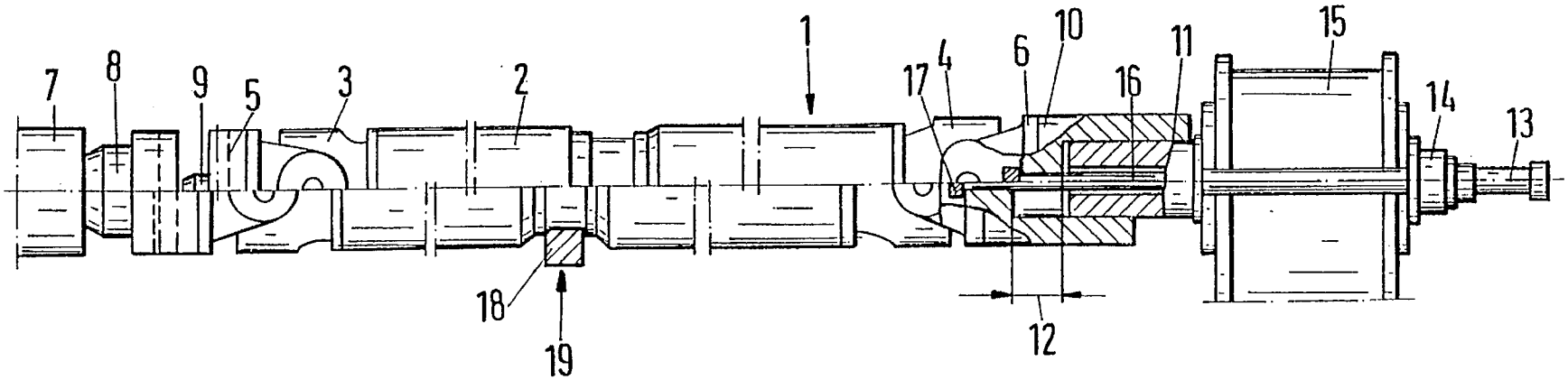
13
14
15
11
16
10
6
12
4
17
1
19
2
18
3
5
9
8
7

DISENGAGEABLE UNIVERSAL SHAFT FOR ROLLING MILL DRIVES

BACKGROUND OF THE INVENTION

1. Field of the Invention

The invention is directed to a disengageable universal shaft for rolling mill. The shaft having a flange on the roll side that can be coupled centrally with the coupling sleeve attached to the roll shaft, and a flange at the gear unit side that is connected with the roll drive via a spline shaft that enables the disengaging movement. The spline shaft being penetrated centrally by the extensible part of a piston-cylinder unit. The relative longitudinal movement between the spline shaft and the flange which brings about the disengagement of the supportable universal shaft being introduced by way of the pressure-medium actuation of the piston-cylinder unit.

2. Description of the Related Art

A generic device for engaging and disengaging universal shafts for rolling mill drives is known from German Patent 19 02 665. The universal shaft described therein has a telescoping length compensation in that the shaft is divided into two parts which are interconnected via a spline shaft so as to be capable of transmitting torque. In order to disengage the universal shaft when changing rolls, the two parts of the universal shaft are moved relative to one another by hydraulic cylinders provided in the interior of these parts or at their surface. The disengaged universal shaft is supported in the region of the flange connections between the drive and output.

Universal shafts of this type or of a similar type have been known for many years and are used in a multitude of rolling mill drives. The cost of devices for support and longitudinal displacement is very high, particularly for large-weight universal shafts used in heavy rolling mills. Manipulation of these universal shafts involves not only manual labor but a considerable expenditure of time. For this reason, continual efforts are made to simplify the disengagement of universal shafts in order to economize on labor and time when changing rolls.

A further disadvantage of the known universal shaft is that costly mechanisms are required for telescoping length compensation. The piston-cylinder unit provided in the interior of the universal shaft in the known solution is costly and difficult to maintain owing to poor accessibility. When the piston-cylinder unit is arranged externally, as is also suggested in the prior art, additional manual labor and time-consuming manipulation using crane installations are required for coupling, which is likewise a negative factor in the time required for changing the rolls The two-part construction of the universal shaft leads to wear in the displacing parts as a result of the high driving torques to be transmitted, even when these displacing parts are produced and maintained at great cost.

SUMMARY OF THE INVENTION

In view of the problems and disadvantages of known universal shafts described above, the object of the present invention is to provide a disengageable universal shaft which, by dispensing with length compensation, is simpler, more economical and easier to maintain and can be used to automate operation so as to minimize the time required for changing rolls by fast engagement and disengagement.

This object is met, according to the invention, by providing the spline shaft at the output stub on the gear unit side.

The output stub is enclosed by a longitudinally displaceable bushing which corresponds to the toothing of the spline shaft and is connected with the flange of the universal shaft on the drive side, which universal shaft is not changeable in length.

The solution according to the invention dispenses with length compensation within the universal shaft so that the latter is substantially simpler and more economical to manufacture. The costly maintenance on known arrangements for longitudinal displacement within the universal shaft is likewise eliminated as are dynamic movements within the universal shaft which result in wear on the parts enabling the displacement. The output stub on the gear unit side is accessible and can be inspected from the outside. Also, the bushing can be connected with the flange as an expendable part which can be exchanged easily.

The spline shaft and bushing are preferably provided with an involute toothing.

In a further embodiment of the invention, the piston-cylinder unit is attached on the side of the gear unit casing remote of the output stub, its piston rod being connected with the universal shaft so as to penetrate the hollow output stub. The piston-cylinder unit which is arranged in a stationary manner on the side of the gear unit remote of the rolling mill is easily accessible for maintenance and inspection work. The gear unit and the output stub are penetrated only by the piston rod which is connected with the flange on the gear unit side in both directions of longitudinal movement so that the universal shaft can be displaced longitudinally via the piston rod.

In still another embodiment of the invention, the piston-cylinder unit can be acted upon during rolling operation by longitudinal force acting in the direction of the coupling sleeve so that screw connections between the flange on the roll side and the coupling sleeve fastened to the roll shaft can be dispensed with. In this way, the universal shaft can be disengaged simply by retracting the piston rod so that the entire universal shaft is uncoupled from the coupling sleeve in the longitudinal direction. The disengaged universal shaft is supported in a known manner by a support reinforcing the shaft. In order to engage the universal shaft, the latter is displaced in the opposite longitudinal direction by the piston-cylinder unit and in the direction of the coupling sleeve by the piston rod, a centering cone helping to guide the coupling into the appropriate position.

In another construction of the invention, the universal shaft can also be supported during rolling operation by a support provided in the central region of the universal shaft. The universal shaft is accordingly supported during operation in a low-weight manner by the support which also reinforces the disengaged universal shaft when the rolls are being exchanged.

The support may be constructed in a known manner as a sliding bearing or the like and can be supported by a compound slide. In the given construction of the universal shaft, the roller bearings are advantageously held apart from the dynamic forces of the universal shaft. This does away with the shocks or impacts which load the roll support and lead to its premature wear.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single FIGURE illustrates an engaged state and a disengaged state of the inventive universal shaft in a split longitudinal view.

DETAILED DESCRIPTION OF THE PREFERRED EMBODIMENTS

The universal shaft according to the invention is designated in its entirety by 1 and has a roll side and a gear side. The universal shaft 1 includes a shaft 2 which cannot change in length. A flange 5 on the roll side and a flange 6 on the gear side, are respectively connected to the ends of the shaft 2 by universal joints 3, 4. The flange 5 on the roll side is outfitted with claws in a known manner and can be connected with a coupling sleeve 8 fastened to a roll shaft 7. A conical pin 9, known per se, is provided for centering the connection at the flange 5 on the roll side.

The flange 6 on the gear side is connected with a coupling bush 10 having at its inner circumference an involute toothing which corresponds with an identical toothing of an output stub 11 on the gear side. The coupling bush 10 is displaceable longitudinally on the output stub 11 by a disengaging stroke 12.

A piston rod 16 is connected with a gear unit housing 15 via a rotary lead-through 14 for displacing the coupling bush 10, and thus the universal shaft 1 connected with it, by the disengaging stroke 12. The piston rod 16 is part of a piston-cylinder unit 13 that penetrates the gear unit 15 and the output stub 11, as shown in the drawing. The piston rod 16 is rigidly connected at its free end 17 with the universal shaft 1 in the axial direction of the shaft.

A support 18, is provided for supporting the universal shaft 1 and is adjustable vertically as indicated by arrow 19.

The drawing shows the division of the universal shaft 1 in the longitudinal direction. The upper half of the drawing shows a disengaged state of the universal shaft 1 and the lower half of the drawing illustrates the universal shaft 1 in an engaged state. During operation, the piston rod 16 pushes the universal shaft 1 against the coupling sleeve 8 by way of the fastening at free end 17. In so doing, the meshing claw teeth, not shown, transmit the driving torque.

The invention is not limited by the embodiments described above which are presented as examples only but can be modified in various ways within the scope of protection defined by the appended patent claims.

We claim:

1. A disengageable universal shaft for driving a roll in a rolling mill, the roll having a shaft with a coupling sleeve connected thereto, comprising:

a fixed-length shaft member having a roll end and a gear end;

a first flange attached to the roll end, said first flange being centrally coupleable with the coupling sleeve attached to the roll shaft;

a second flange attached to the gear end;

an output stub having an outer toothing;

a longitudinal displaceable coupling bushing having a toothing that corresponds to the toothing of said output stub, said bushing enclosing said output stub and being connected with the second flange of said shaft member; and piston-cylinder means connected to said output stub and said second flange for providing relative longitudinal movement between said output stub and said second flange.

2. A disengageable universal shaft according to claim 1, wherein the output stub is hollow and the piston-cylinder includes a piston rod connected with the shaft member so as to penetrate the hollow output stub.

3. A disengageable universal shaft according to claim 2, wherein the piston-cylinder means is adapted so that during a rolling operation, a longitudinal force is actable on the piston-cylinder means in a direction of the coupling sleeve.

4. A disengageable universal shaft according to claim 1, and further comprising means for supporting the shaft member in a central region during a rolling operation.

5. A disengageable universal shaft according to claim 1, and further comprising universal joints that connect the flanges to the shaft member.

* * * * *